US005469717A

United States Patent [19]

Shibuta et al.

[11] Patent Number: 5,469,717

[45] Date of Patent: Nov. 28, 1995

[54] METHOD FOR KNITTING A CROSSING PATTERN AND AN APPARATUS FOR KNITTING A CROSSING PATTERN IN FLAT KNITTING MACHINE

[75] Inventors: Takekazu Shibuta; Toshinori Nakamori; Ikuhito Hirai, all of Wakayama, Japan

[73] Assignee: Shima Seiki Mfg., Ltd., Wakayama, Japan

[21] Appl. No.: 169,138

[22] Filed: Dec. 20, 1993

[30] Foreign Application Priority Data

Dec. 22, 1992 [JP] Japan ..... 4-342629

[51] Int. Cl.[6] ..... D04B 7/00

[52] U.S. Cl. ..... 66/69; 66/64; 66/148

[58] Field of Search ..... 66/69, 64, 148, 66/189

[56] References Cited

U.S. PATENT DOCUMENTS

| | | | |
|---|---|---|---|
| 3,446,042 | 5/1969 | Fontaine | 66/148 |
| 3,841,114 | 10/1974 | Vandermeirsch | 66/148 |
| 4,905,483 | 3/1990 | Shima | 66/64 |
| 5,365,756 | 11/1994 | Nakamori et al. | 66/64 |

FOREIGN PATENT DOCUMENTS

| | | | |
|---|---|---|---|
| 0103033 | 9/1982 | European Pat. Off. . | |
| 103033 | 3/1984 | European Pat. Off. | 66/148 |
| 0310730 | 10/1987 | European Pat. Off. . | |
| 0286050 | 4/1988 | European Pat. Off. . | |
| 2620137 | 8/1988 | France . | |
| 16-7907 | 4/1941 | Japan . | |
| 56-21854 | 5/1981 | Japan . | |
| 63-256752 | 10/1988 | Japan . | |
| 1-168943 | 7/1989 | Japan . | |

*Primary Examiner*—John J. Calvert

*Attorney, Agent, or Firm*—Armstrong, Westerman, Hattori, McLeland & Naughton

[57] ABSTRACT

A method and apparatus for knitting a cross pattern texture on a flat knitting machine comprising front and rear needle beds, each needle bed having a plurality of needle grooves parallel and equally spaced along a length of the needle beds and each of such grooves having a needle therein, needle cams for selectively advancing and retracting the needles in the needle grooves transverse the needle beds for forming knit stitches on the needles in yarn fed to the needles as such needles are advanced and retracted in the needle grooves, a transfer jack supported above each of the needle beds and each moving transverse of the jack beds in jack grooves in the jack beds, a transfer cam for selectively moving each of the transfer jacks in the jack grooves, a lift cam protruding into a cam groove of the transfer cam and means for moving the lift cam into and out of the cam groove, wherein each of the transfer jacks is retracted in the jack groove or remains forward depending on the lift cam's position in the cam groove of the transfer cam.

3 Claims, 18 Drawing Sheets

METHOD FOR KNITTING A CROSSING PATTERN AND AN APPARATUS FOR KNITTING A CROSSING PATTERN IN FLAT KNITTING MACHINE

BACKGROUND OF THE INVENTION

1. Field of the Invention

The present invention relates to a method for knitting a crossing pattern and an apparatus for knitting a crossing pattern in a flat knitting machine.

2. Description of the Related Art

In a usual flat knitting machine, a pair of needle beds which contain movable knitting needles are arranged to form an inverted V-shaped form in a side view. In knitting a rib knit fabric or a tubular knit fabric by using front and rear knitting needles of this flat knitting machine, it is impossible to decrease stitches at an intermediate portion in a row of stitches because there is no knitting needle for temporally holding a loop to be moved.

To solve this problem, Japanese Examined Patent Publication No. 41-7907 discloses a flat knitting machine, wherein a pair of needles beds, containing movable knitting needles, are arranged to form an inverted V-shaped form in a side view. A transferring jack bed, containing movable jacks in jack grooves, is provided above each needle bed. A stitch to be transferred is transferred from the knitting needle to the transferring jack, and the stitch engaged with the transferring jack is transferred to another knitting needle after the transferring jack engaged with the stitch is moved in a transverse direction.

Further, Japanese Unexamined Patent Publication No. 1-168943 discloses a flat knitting machine, wherein a transferring jack bed is supported above a needle bed by supporting members. Transferring jacks, at the front ends of which stitch engaging portions are formed, are movably arranged in the transferring bed. The transferring jacks are moved forward and backward by a transferring cam accompanied with a carriage. The transferring jack bed is moved in a transverse direction by a driving means provided at one side of the transferring jack bed. A stitch engaged with the stitch engaging portion is moved in a transverse direction and the stitch is transferred to another knitting needle.

Furthermore, Japanese Examined Patent Publication No. 56-21854, of the present applicant, and Japanese Unexamined Patent Publication No. 63-256752 disclose a flat knitting machine, wherein a transferring jack bed, containing movable jacks grooves, is provided above a needle bed. A stitch to be transferred is transferred from the knitting needle to the transferring jack. The stitch engaged with the transferring jack is transferred to another knitting needle after the transferring jack engaged with the stitch is moved in a transverse direction.

However, according to the flat knitting machines having a stitch transferring mechanism described in each of the above publications, a transferring jack moves forward and backward with a transferring cam running accompanied with a carriage, and a stitch is transferred with the transferring jack moved forward and backward, each time the carriage runs.

In those cases, for example where a rope like crossing pattern is formed while a rib knit is knitted using all of the knitting needles at the front and the rear, each stitch of at least a pair of stitches, which are intended to cross, is transferred from a needle with which the stitch is engaged, to a transferring jack located above the knitting needle or above a needle facing the needle, and after the transferring jack is moved in a direction toward a position of the transferred stitch to be crossed, keeping the transferred stitch at a distal end of the transferring jack, the crossed stitch is transferred to a knitting needle to complete the crossing pattern. However, there is a problem that a crossing pattern can not be formed while a rib knit fabric, or a tubular knit fabric, is knitted using all of the knitting needles, because the transferring jack is moved forward and backward every time the carriage runs and a stitch transferred to the transferring jack is cleared because the transferring jack is pulled in when the carriage passes which results in inability of keeping the stitches engaged with the stitch engaging portions of the transferring jack.

SUMMARY OF THE INVENTION

The present invention is proposed in consideration of the above problem. An object of the present invention is to provide a method for knitting a crossing pattern and an apparatus for knitting a crossing pattern in a flat knitting machine, which makes it easier to form a crossing pattern even while both of the front and rear knitting needles are used in such an occasion of knitting a rib knit fabric or a tubular knit fabric.

To achieve the above object, a process for knitting a crossing pattern texture in a flat knitting machine of the present invention which has a pair of front and rear needle beds, a transferring jack bed supported by each of the needle beds, and a transferring jack contained movably forward and backward in a jack groove formed on the transferring jack bed, and comprises the steps of transferring at least one set of stitches to be crossed from a knitting needle on the needle bed separately to the transferring jack of each of the front and rear transferring jack beds, passing a carriage keeping either of the transferring jacks engaged with the separately transferred stitches, from being pulled in, shifting the transferring jack bed toward a position where the separately transferred stitches are to be crossed, and transferring the crossed stitches from the front and rear transferring jacks to a knitting stitch.

A knitting apparatus for knitting a crossing pattern texture in a flat knitting machine of the present invention comprises a pair of a front and rear needle beds, a transferring jack bed supported by a supporting part of each of the front and rear needle beds, a transferring jack movably forward and backward in a jack groove disposed in a row on the transferring jack bed, a transferring cam moving the transferring jack forward and backward by acting on a jack butt, the transferring cam having a cam groove, a lift cam protruding in the cam groove to pull in the transferring jack, and the lift cam being constituted so as to be switched in and out, wherein either an operating path where the transferring jack is pulled into the cam groove or a bypass path where the transferring jack passes as protruding is selected depending on the lift cam's switching in or out.

Further, in a knitting apparatus for knitting a crossing pattern texture in a flat knitting machine of the present invention, a pair of transferring jacks facing each other are disposed at different positions in a longitudinal direction of the transferring jack bed whereby the transferring jacks do not interfere with each other at distal ends thereof when the transferring jacks are extruded, the front and rear transferring jack beds are connected to each other at least one ends there of, and the connected front and rear transferring jack beds can be moved in a longitudinal direction of the transferring jack bed.

Further, in a knitting apparatus for knitting a crossing pattern texture in a flat knitting machine of the present invention, the front and rear transferring jack beds facing each other maybe constituted so as to be relatively moved with a driver mounted on at least one of the transferring jack beds.

When the carriage is let go and return between the knitting needles covering a predetermined width of the needle bed, the needles of the front and rear needle beds are moved forward and backward by the carriages and, consequently, a desired texture, with a predetermined width, such as a rib knit fabric, or a tubular knit fabric, is knitted.

In order to form a crossed pattern during knitting a texture, first knitting needles engaged with specific stitches to be crossed are pushed out by a transfer raising cam mounted on the carriage, a transferring jack is extruded by a transferring cam, and the specific stitches to be crossed are transferred separately to each of the front and rear transferring jacks, respectively, by transferring the stitches at the pushed out needles to the transferring jacks.

Next, in order to get the crossing pattern, the stitch to form an upper side of the crossing pattern is transferred from a transferring jack to a knitting needle on the needle bed first, while the transferring jack bed is moved while holding a stitch at a distal end of the front and rear transferring jacks. During this step, a bypass path is used so that, in a following course, a transferring cam does not pull in the transferring jack engaged with a stitch to be transferred crossing under the stitch transferred in the previous course.

In a following course, a bed at a transferring jack side is shifted by a predetermined length, while holding the stitch, whereby a crossing pattern is formed, which leads the stitch to be transferred from the transferring jack to the knitting needle of the needle bed, and the crossing pattern is completed.

DESCRIPTION OF THE PREFERRED EMBODIMENTS

First, an embodiment of the present invention is described.

Figure 1:
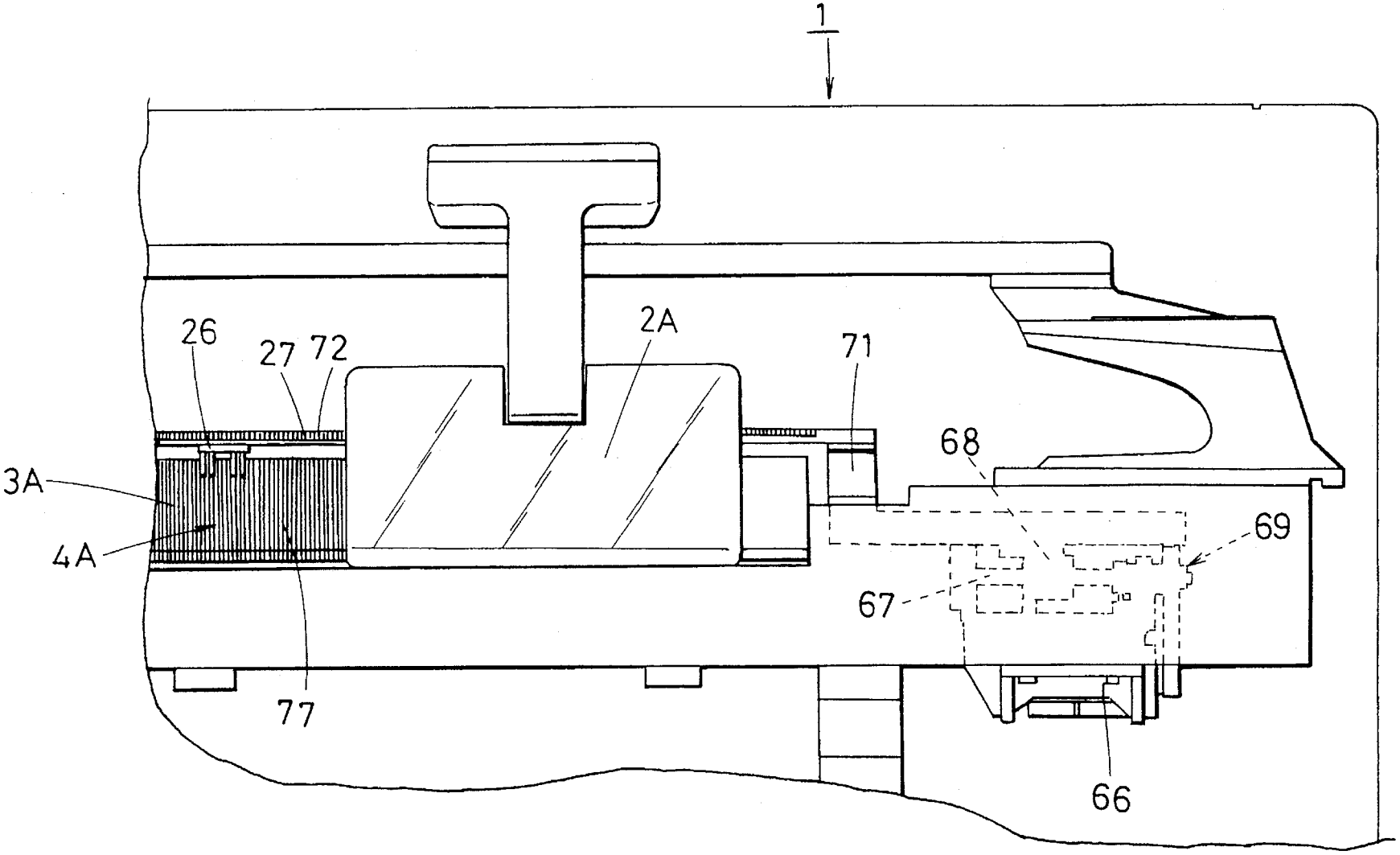
FIG. 1 is a schematic partly cross sectional elevational view of a flat knitting machine of the present invention.
Figure 2:
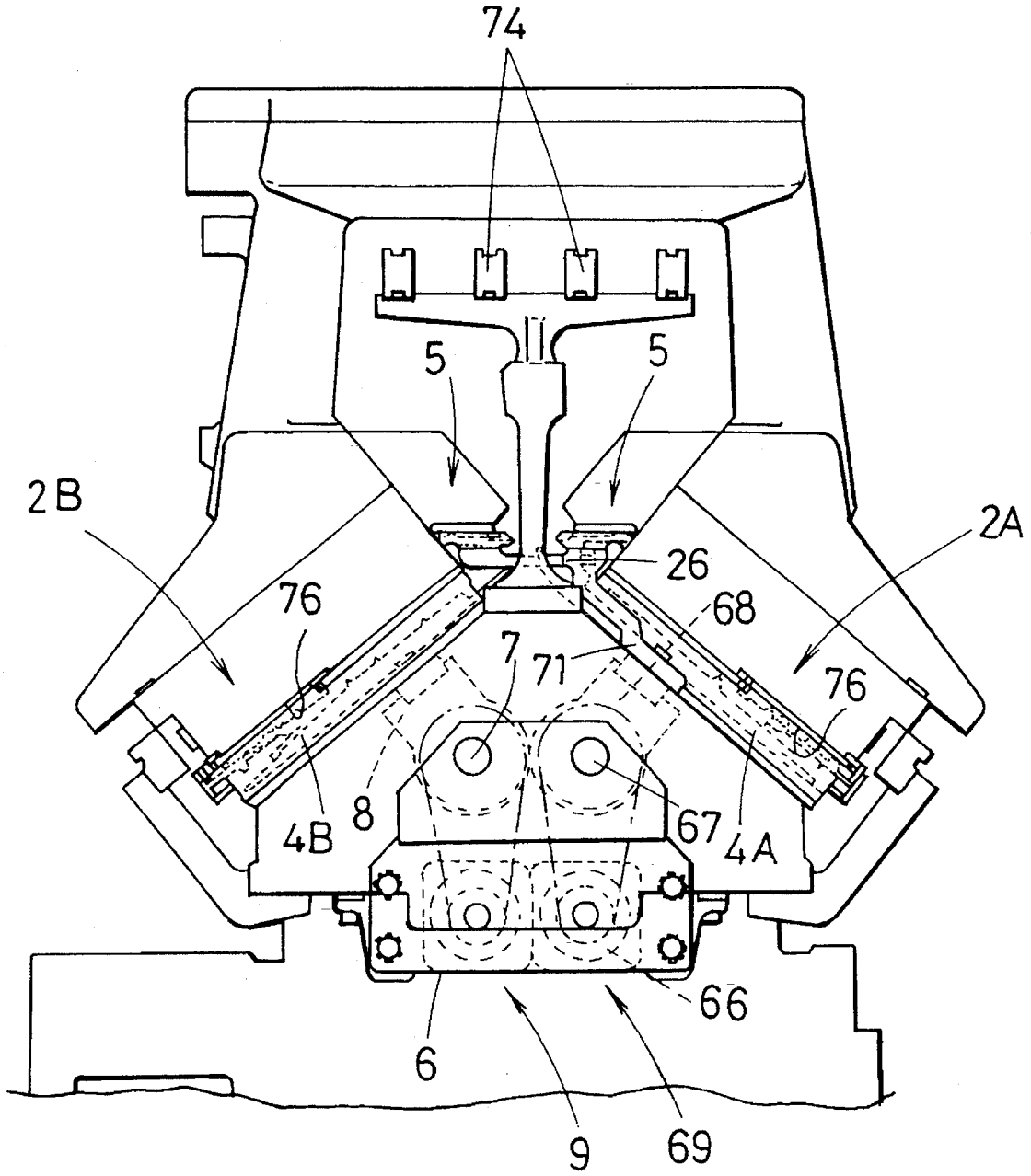
FIG. 2 is a schematic partly cross sectional side view of a flat knitting machine of the present invention.
Figure 3:
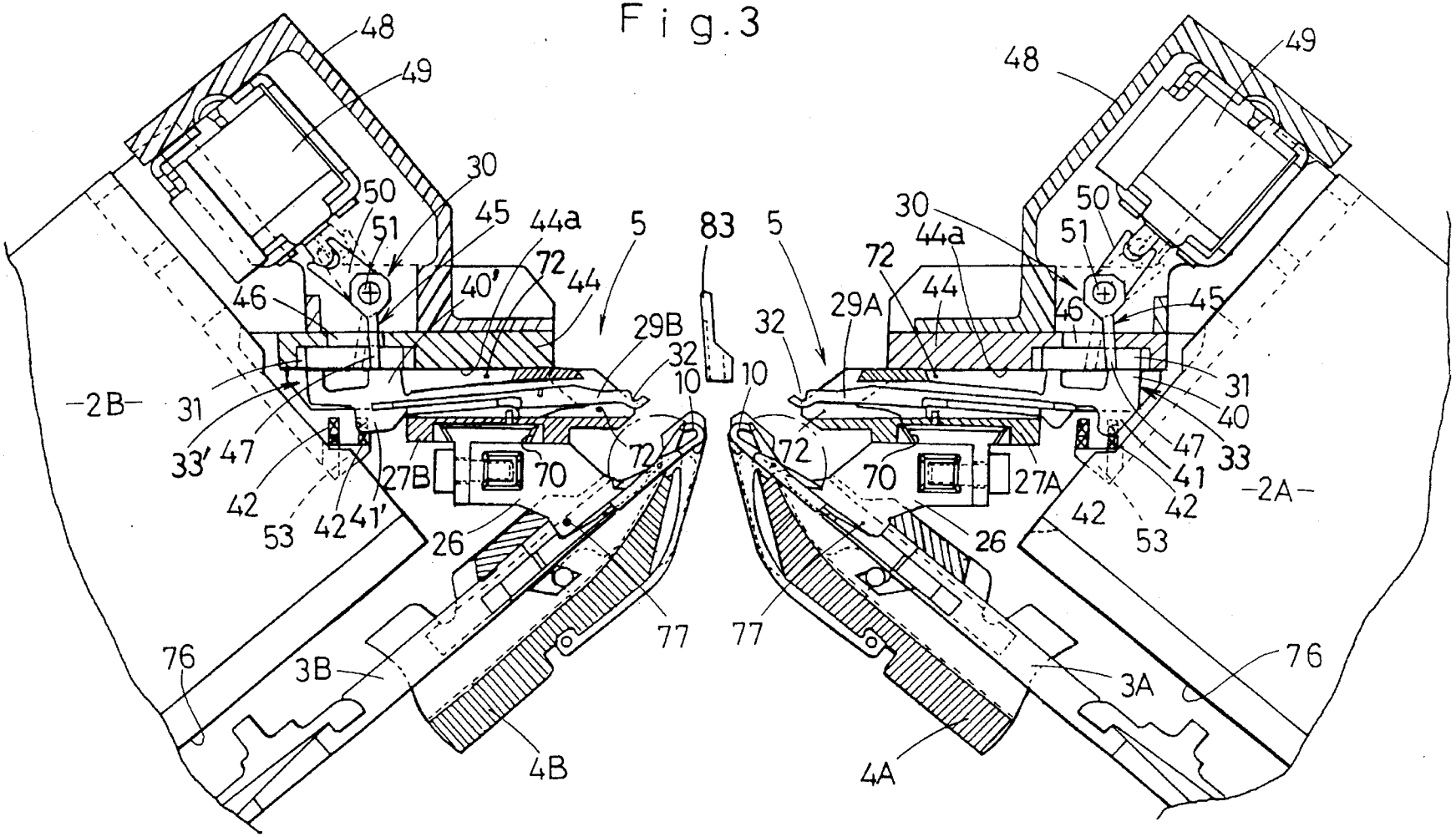
FIG. 3 is a schematic enlarged cross sectional side view of the principal part of the flat knitting machine of the present invention.

FIG. 1 is a schematic elevational view of a first embodiment of a flat knitting machine having a transferring mechanism, FIG. 2 is a side view of FIG. 1, and FIG. 3 is an enlarged cross-sectional side view of FIG. 2. Referring to FIG. 1 through FIG. 3, reference numeral 1 designated the flat knitting machine.

The knitting machine 1 comprises a flat front lower needle bed 4A and a flat rear lower needle bed 4B which are arranged facing each other to form an inversed V-shaped form in a side view. Each transferring mechanism 5 is arranged above each needle bed 4A, 4B respectively. In each of the needle beds 4A, 4B, a number of knitting needles 3A, 3B, as shown in FIG. 3, are arranged, respectively, so as to be movable in needle grooves 77 by carriage 2A, 2B. The rear needle bed 4B is movable in transverse direction by a driving means which comprises a motor 6, a driving screw shaft 7, a slider 8, and the like (see FIG. 2).

Figure 4:
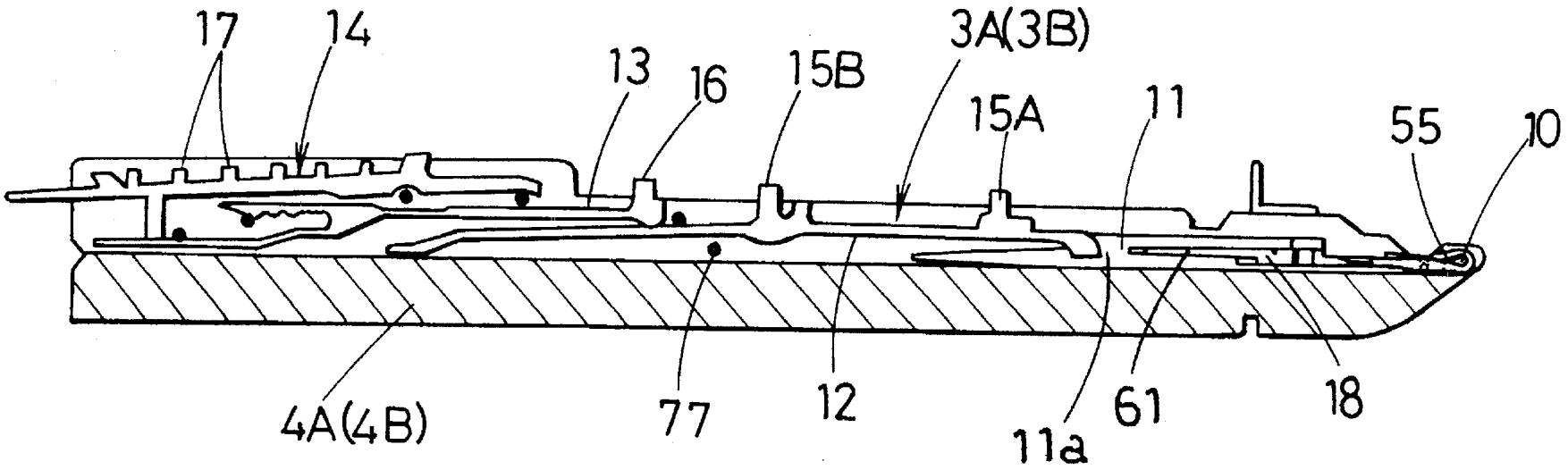
FIG. 4 is a side view of the portion involving the knitting needle of a flat knitting machine of the present invention.

Referring to FIG. 4, the knitting needle 3A or 3B arranged in the needle groove 77 of the needle bed 4A or 4B comprises a knitting needle body 11 at the end of which a hook 10 is formed, a jack 12 which is connected to the rear end portion of the knitting needle body 11, a selecting jack 13 arranged at the rear portion of the jack 12, and a selector 14 arranged on the selecting jack 13. Butts 15A and 15B are projected upwardly from the jack 12, and butt 16 is projected upwardly from the selector 14. When butts 15A, 15B, 16, and 17 move along a cam surface 76 of the carriages 2A, 2B, the jack 12, the selecting jack 13, and the selector 14 move in the needle groove 77.

An expanding member 18 for expanding a loop retained by the knitting needles 3A or 3B and elasticity allowing portion and a spring portion 61 are arranged at a one side of the knitting needle body 11. The expanding member 18 is formed by bending sheet metal into a boat like shape, in plan view and the end of the expanding member 18 is fixed to the one side of the knitting needle body 11.

The elastic part 61, formed in a knitting needle 3A(3B) described above, is made so that a free end part of a loop expanding member 18, extending in one side part 11*a* of a knitting needle body 11, contained in a needle groove 77, is bent outward to bulge. The bulged part is positioned to abut on a side face of the needle groove 77 and its reaction force pushes the other side part of the knitting needle body 11 on the side face of the needle groove 77 facing the other side part of the knitting needle body.

Figure 5:
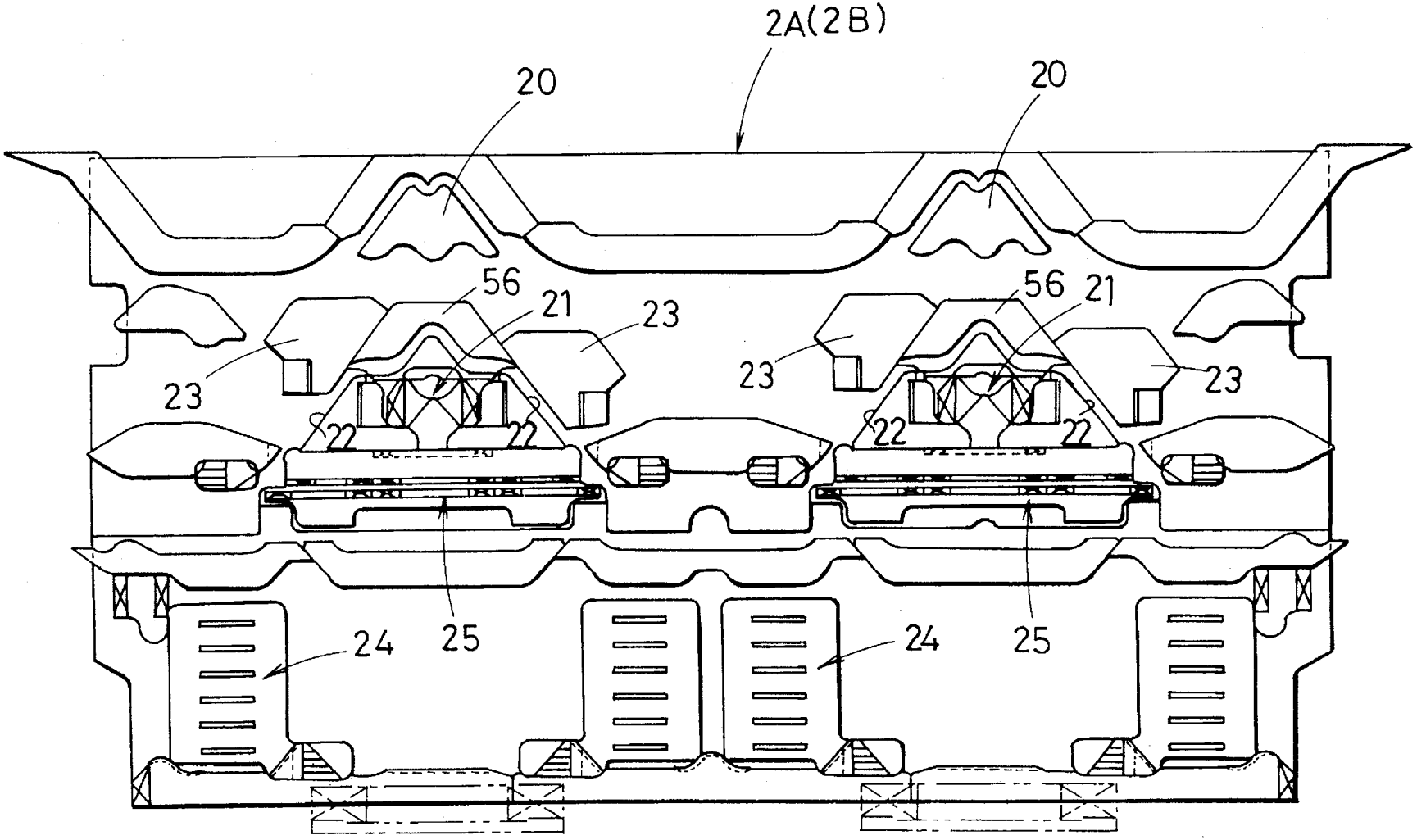
FIG. 5 is a schematic elevational view of the group of cams of the carriage of a flat knitting machine of the present invention.

Referring to FIG. 5, group of cams of the carriages 2A and 2B over the needle beds 4A and 4B comprises two cam units arranged side by side. The cam unit comprises a transferring raising cam 20 protruded and retracted by a solenoid or a motor (not shown), a substantially trapezoid transferring receiving cam 21 arranged under the transferring raising cam 20, and can be protruded and retracted, needle raising cams 22 formed at the sides of the transferring receiving cams 21, and a convex portion 23 at the upper portion of the needle raising cams 22. Under the group of cams, a needle selecting actuator 24 which acts on butts 17 of the selector 14 of the knitting needles 3A and 3B is arranged. Between the needle selecting actuator 24 and the group of cams, a pressor mechanism 25 which acts on the butt 16 of the selecting jack 13 of the knitting needles 3A and 3B so that the knitting needles 3A and 3B are located at the position for knitting, tucking, missing and transferring.

Each transferring mechanism 5, arranged between carriage 2A and 2B, is supported by each of the flat transferring jack beds 27A, 27B (see FIG. 3). Each of the transferring jack beds 27A, 27B is supported by each supporting member 26 which is provided at each of the needle beds 4A, 4B via each slide mechanism 70. The transferring jack beds 27A and 27B are connected to each other at the end portions thereof by moving control bracket 71, FIG. 2. Control bracket 71 is driven by a driving means 69 which comprises a motor 66, driving screw shaft 67, slider 68, and the like (see FIGS. 1 and 2).

In the transferring jack beds 27A and 27B, jack grooves 72 in which the transferring jack 29A and 29B are movably positioned are formed. On each transferring jack bed 27A or 27B, each transferring cam 31 and each needle selecting mechanism 30 for selecting the transferring jacks 29A and 29B are positioned.

Figure 7:
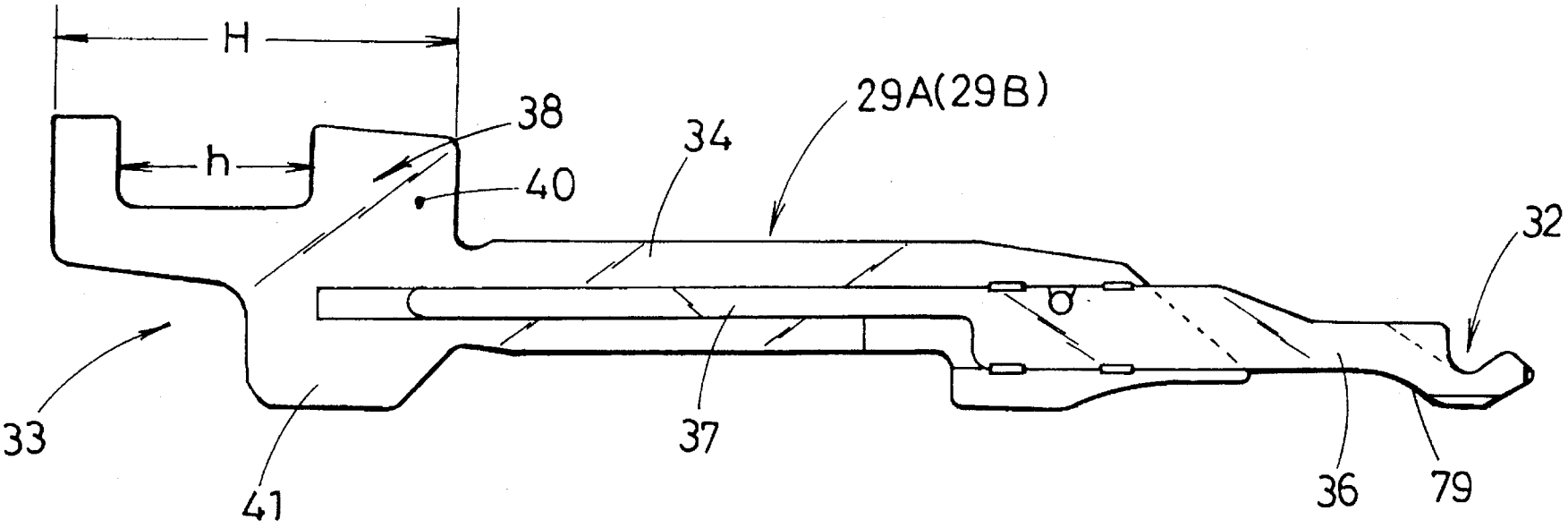
FIG. 7 is a side view of the portion involving the transferring jack and the knitting needle of a flat knitting machine of the present invention.
Figure 8:
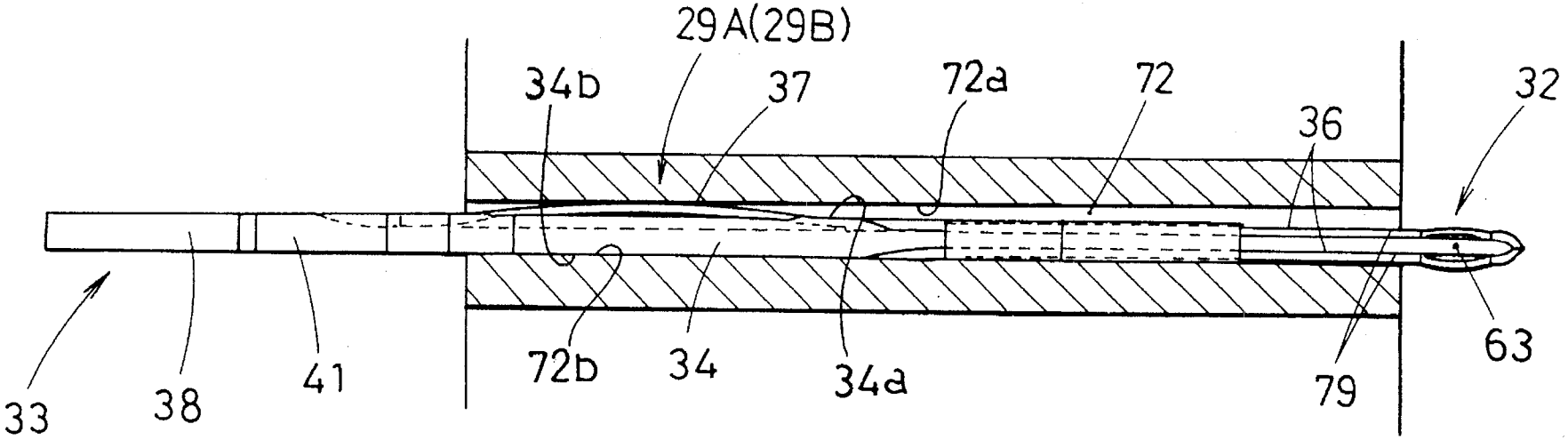
FIG. 8 is a bottom plan view of the transferring jack of a flat knitting machine of the present invention.
Figure 9:
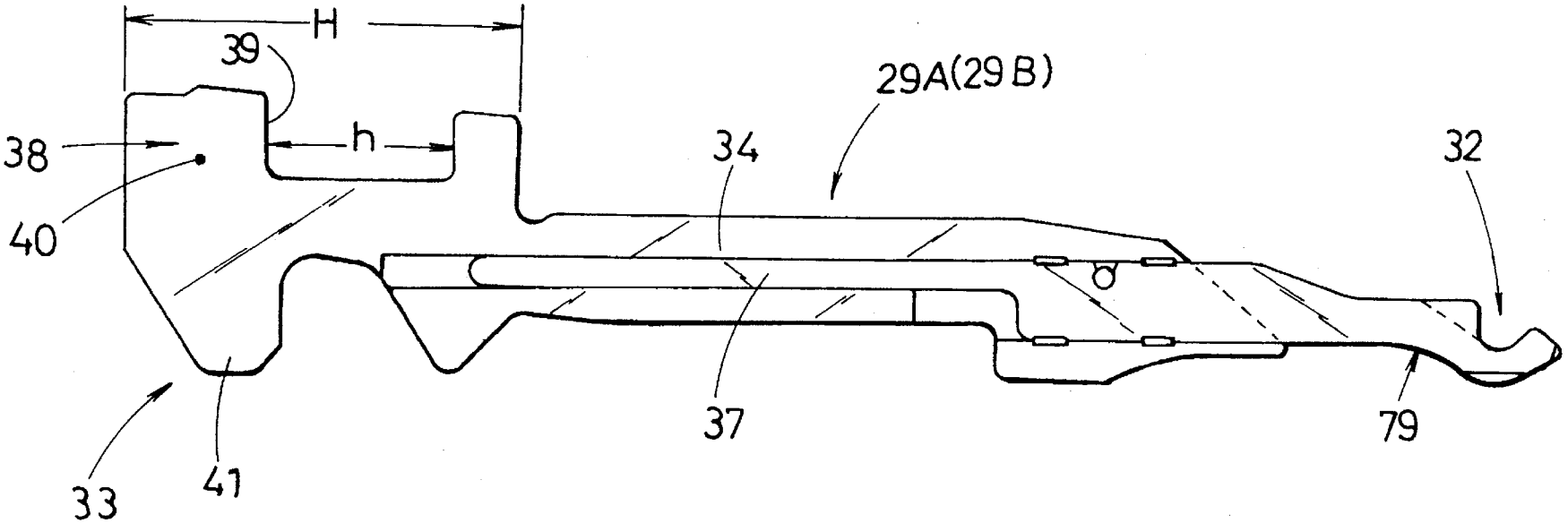
FIG. 9 is a side view of the transferring jack of a flat knitting machine of the present invention.

Referring to FIG. 7 through FIG. 9, a hook shaped stitch engaging portion 32 is formed at the front end of the transferring jack 29A (29B), a needle selected portion 33 is formed at the rear end of the transferring jack 29A (29B), and a curved portion 79 is formed at the jack body 34 side of the stitch engaging portion 32.

The stitch engaging portion 32 is formed as a hook, in a side view, at a distal end of a spring steel 36 of a narrow width plate extended from both right and left sides at a tip part of the jack body 34. The distal ends are bent to abut each other, forming a space 63, FIG. 8, in a plan view, which a knitting needle enters. An elastic part 37 is formed at a base end part of the spring steel 36 at one side part of the jack body 34.

The elastic part 37 is made so that base end 36, of a spring steel, located at one side face 34*a* of a jack body 34 in a jack groove 72, is bent outward to bulge, the bulged part 36*a* is positioned to abut on a side face 72*a* of the jack groove 72. Its reaction force pushes the other side part 34*b* of the jack body 34 on the side face 72*a* of the jack groove 72 facing the other side part of the jack body (see FIG. 8).

The needle selected portion 33 comprises a plate 38 with a length H, FIG. 7, and a return butt 41 with which a return cam 42 (referred to hereinafter) acts. At the plate 38, a groove, with a width h, is formed and forms a needle selected butt 40. The position of the needle selected butt 40 in FIG. 7 is different from needle selected butt 40' in FIG. 9, that is, the needle selected butts 40 In FIG. 7 and the needle selected butt 40 in FIG. 9 have different phases. According to this difference, the position of the return butt 41 in FIG. 7 is also different from the return butt 41" in FIG. 9. Transferring jack groups are formed from a plurality of transferring jacks 29A (29B) having the same needle selected members 33 transferring jack groups of different selected members 33, 33' are arranged, alternatively, every 1 inch.

Figure 6:
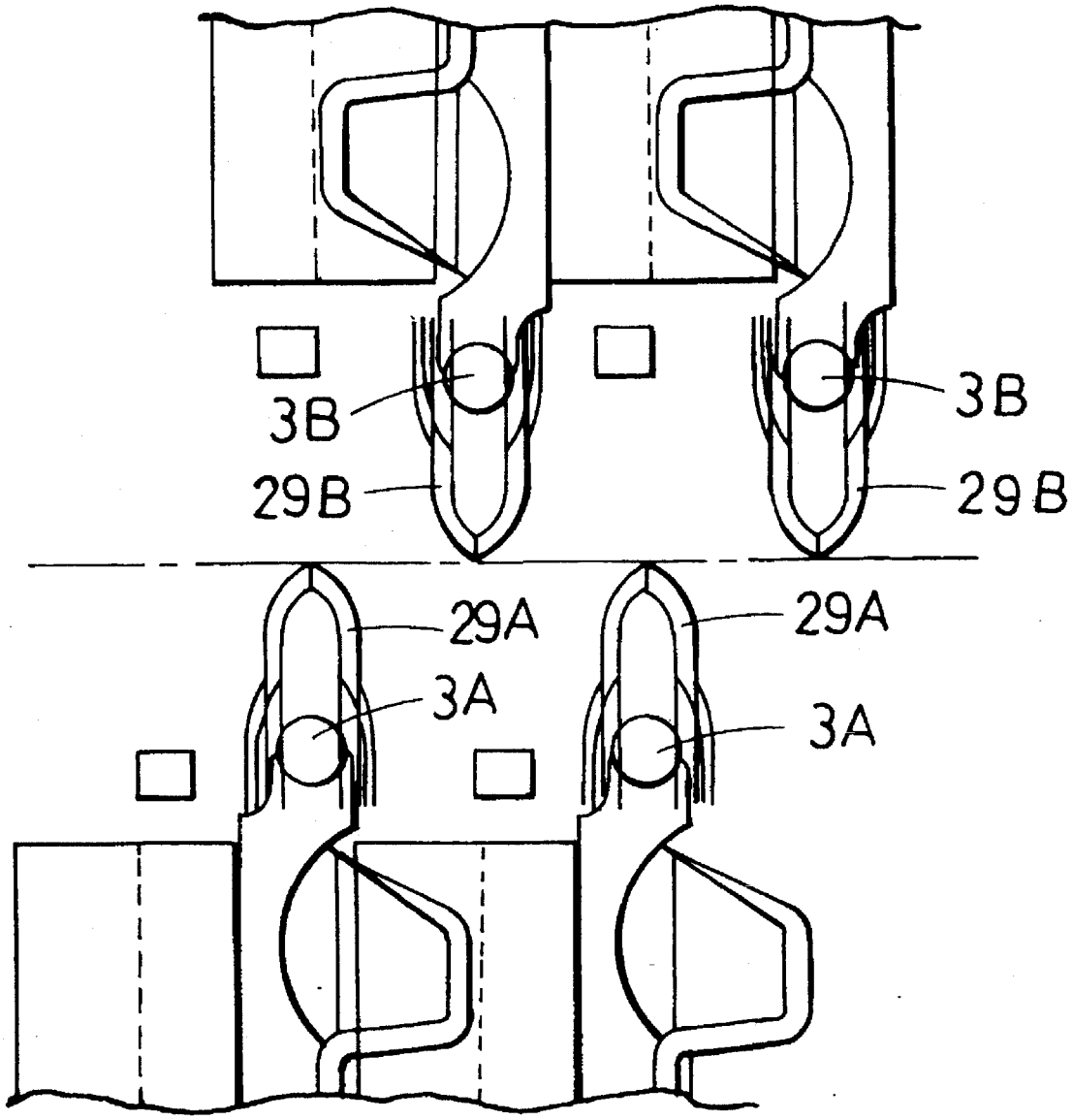
FIG. 6 is a plan view of the portion involving the transferring jack and the knitting needle of a flat knitting machine of the present invention.

In a case such as the above embodiment, that each of transferring jack beds 27A (27B) is disposed above each of front and rear needle beds 4A (4B), respectively, driven by one motor 66, as described above, the transferring jack beds 29A (29B) are arranged at different positions along the longitudinal direction of the transferring jack beds 27A (27B) so that the distal ends of the facing transferring jacks 29A (29B) do not interfere with each other when extended, as shown in FIG. 6. This is to prevent the distal ends of the transferring jacks 29A (29B) from intereference with each other, when the transferring jacks 29A (29B) facing each other are extended at the same time for an actuator of a needle selecting means 30, described later, to select a block of needles which are to be selected, for each unit of block.

Further, in such a case, because a driving motor is disposed for each of the front and rear transferring jack beds 27A (27B), or one of the transferring jack beds is driven by its own motor and another transferring jack bed is driven by a needle bed driving motor, respectively, the distal ends of the facing transferring jacks 29A (29B) can be prevented from interferring with each other, even when needle-selecting for each unit of block, if the facing transferring jack beds 29A (29B) are shifted to avoid interference only while extending at the same time.

According to needle beds 4A (4B) and stitch transferring mechanism 5 described above, a stitch engaged with a knitting needle 3A of a front needle bed 4A can be transferred to a knitting needle 3B of a rear needle bed 4B or each of transferring jack (sliding member) 29A (29B) of front and rear transferring jack beds 27A (27B) described later, and a stitch engaged with a stitch 3B of a rear needle bed 4B can be also transferred to a needle 3A of a front needle bed 4A or each of transferring jack 29A (29B) of front and rear transferring jack beds 27A (27B).

Referring to FIG. 3, the transferring cam 31 for acting on the needle selected butt 40, 40' of the needle selected member 33, 33', as the case may be, and the return cam 42 for acting the return butt 41, 41' are arranged at the space between the carriage 2A (2B) on the needle bed 4A (4B) and a yarn guide 83 arranged over an aperture between the needle beds 4A and 4B.

Figure 10:
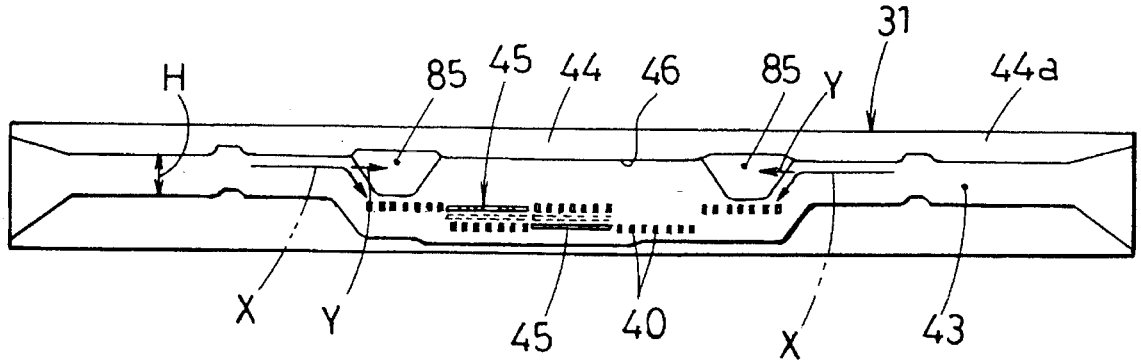
FIG. 10 is an elevational view of the transferring cam; is a perspective partly cross sectional view of the transferring jack of a flat knitting machine of the present invention.

The above described transferring cam 31 is made, as shown in FIG. 10, so that a cam plate 44, forming a cam groove 43 of a predetermined width H of the butt 40 for needle selection, is projected on a side face of carriage 2*a* (2B) so as to get its lower surface 44*a* to abut on and slide along an upper surface of transferring jack bed 27A (27B). Lift cams 85 FIG. 10, shaped in an inverted trapezoid, is disposed at right and left at, approximately, central part of the cam groove 43. The butt 40 is guided along the side face of the lift cam 85 when the lift cam 85 is projected in the cam groove 43 and the transferring jack 29A (29B) is pulled in along a path X (arrow of a imaginary line), and the butt 40 is guided along the straight bypass path Y (arrow of a solid line) when the lift cam 85 is lifted up.

Figure 11:
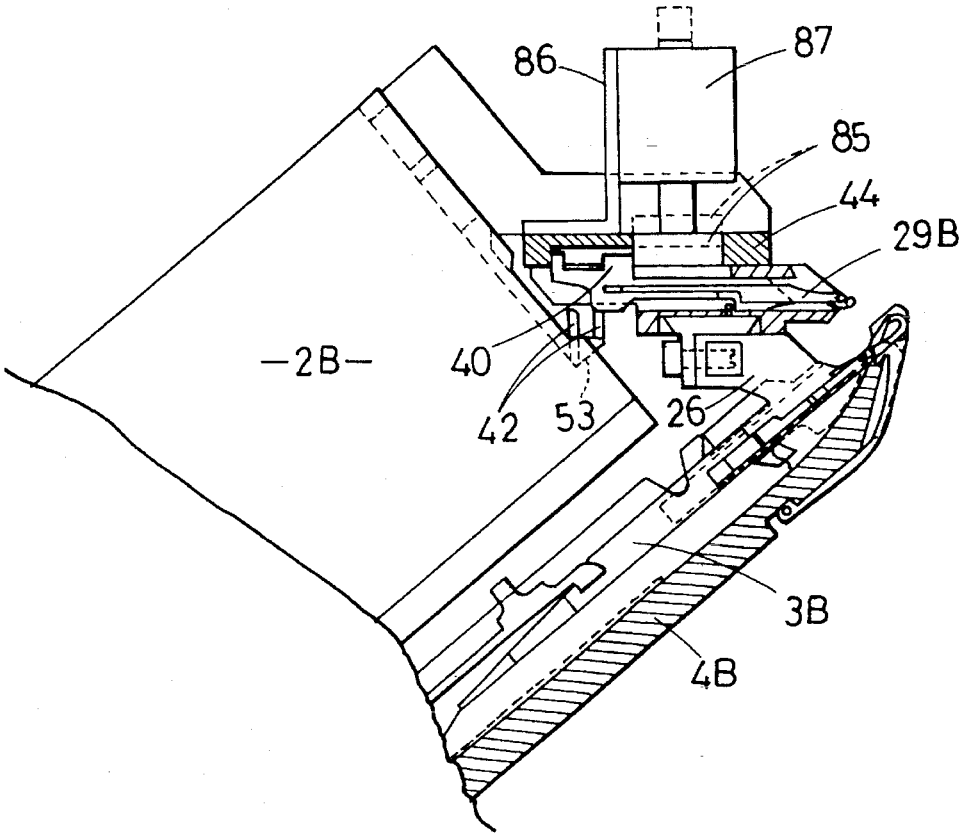
FIG. 11 is a schematic enlarged cross sectional view of the lift cam.

As shown in FIG. 11, a shifting means for the lift cam 85 includes a solenoid 87 supported by L shaped bracket 86 at an upper face of the cam plate 44 and a controller (not shown in a drawing) to control an operation timing of the solenoid 87, and the lift cam 85 is fixed at a lower end of an output rod of the solenoid 87.

The return cam 42 for acting the return butt 41, 41' is fixed to a bracket 55 which is fixed to the side portion of the carriage 2A (2B). At the center of the cam groove 43 of the cam plate 44 FIG. 3, operation holes 46 through which operating portion of an actuator 45 of a needle selecting means 30 for operating the needle selected butt 40 is provided.

Figure 12:
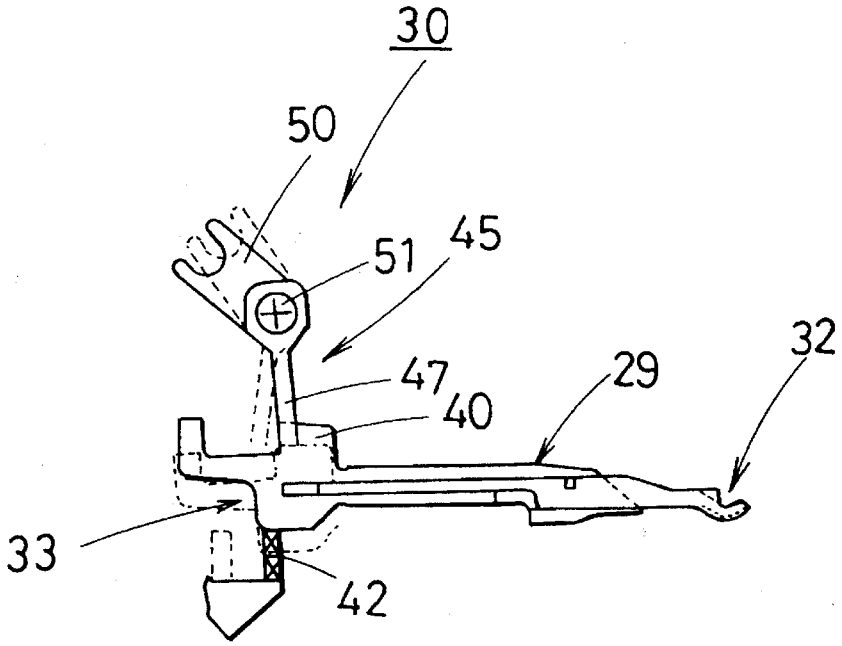
FIG. 12 is a side view of the principal part illustrating the action of the transferring jack in FIG. 6.
Figure 13:
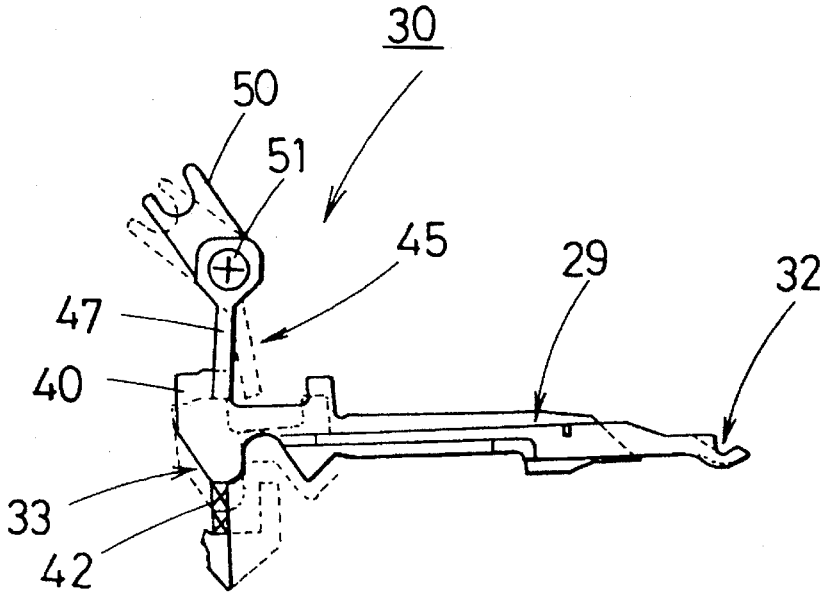
FIG. 13 is a side view of the principal part illustrating the action of the transferring jack in FIG. 8.

Referring to FIG. 3, needle selecting means 30 comprises a solenoid 49, a swinging lever 50, supporting axis 51, and a needle selecting cam plate. The solenoid 49 is fixed to casing 48 which is fixed to the carriage 2A (2B). The solenoid 49 is connected to the one end of the swinging lever 50 and the other end thereof is fixed to the supporting axis 51. The needle selecting cam plate 47 which passes through the operation hole 46 and operates as the operating portion of the actuator 45 is also fixed to the supporting axis 51. Different needle selecting means 30 are arranged in transferring jack bed 27A or 27B, respectively, corresponding to the transferring jacks 29A (29B) (see FIG. 12 and FIG. 13).

Figure 14:
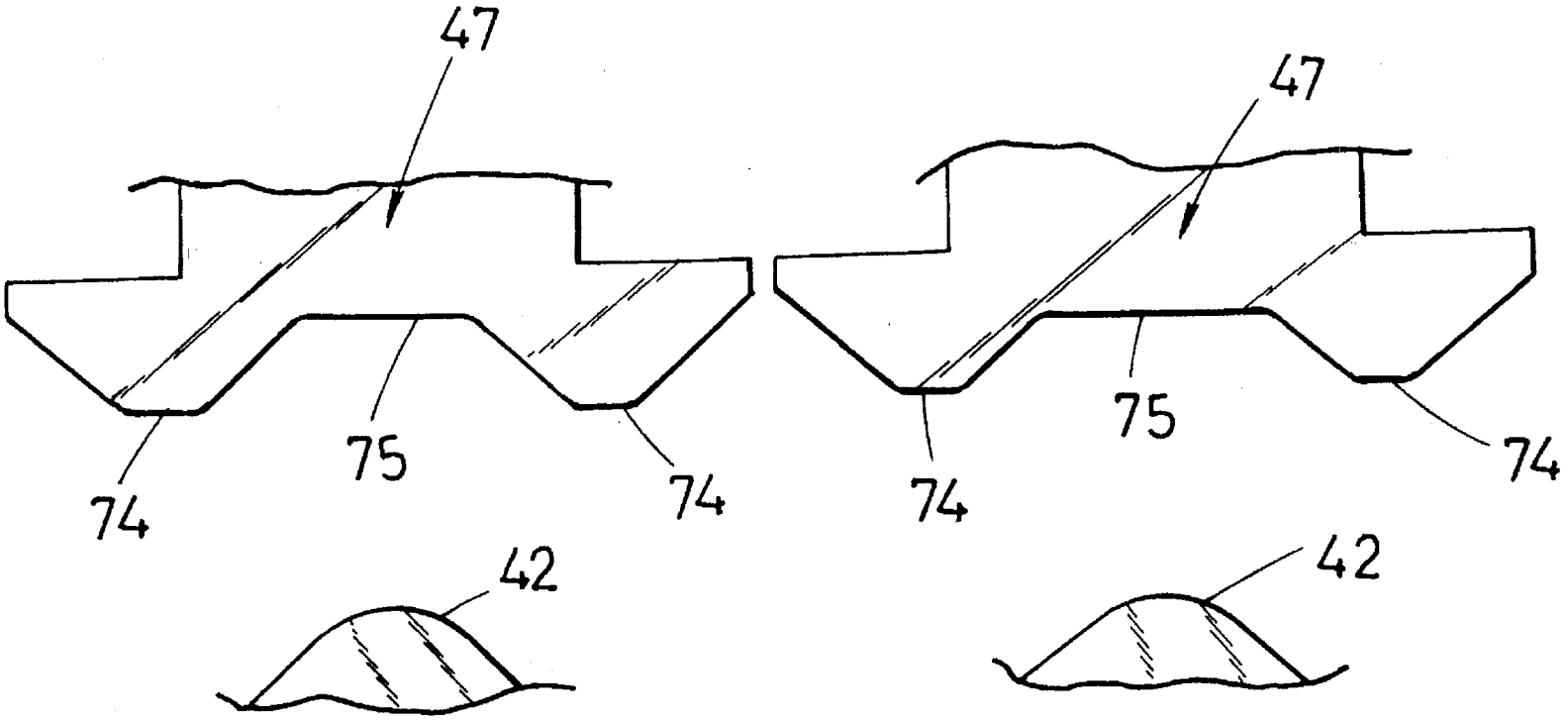
FIG. 14 is a schematic partly cross sectional elevational view of the cam plate and the restoring cam.

Referring to FIG. 14, at the low end portion of the cam plate 47, 47, convex portions 74, 74, are formed at the opposite ends of the lower end portion and a recess portion 75 is formed in central portion of each convex portion 74. Return cam 42, for acting the return butt 41 of the transferring jack 29A (29B), is arranged at the position facing to the recess portion 75.

Next, the following is a case where a crossing pattern of 2×2 from a bag type texture is shown in FIGS. 15A-D and 18A-B. In the drawing, FD indicates a front needle bed 4A, BD is for a rear needle bed 4B, FU is for a front transferring jack bed 27A, BU is for a rear transferring jack bed 27B, capital letters ABC . . . are knitting needles, and small letters abc . . . indicate transferring jacks, respectively.

Figure 15A:
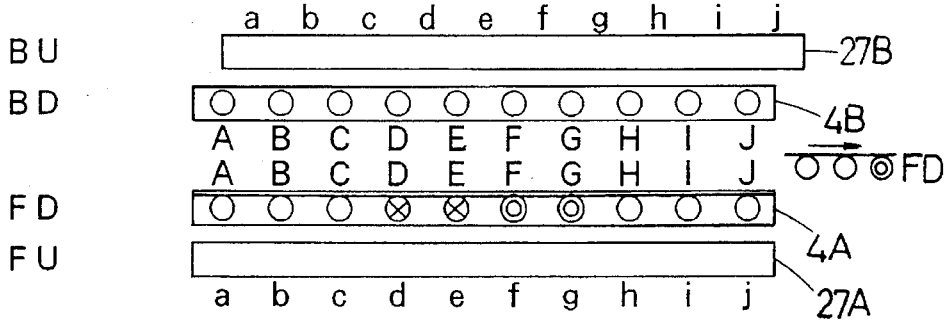
FIGS. 15A through 15D are explanatory drawings of knitting courses of a crossing pattern.
Figure 15B:
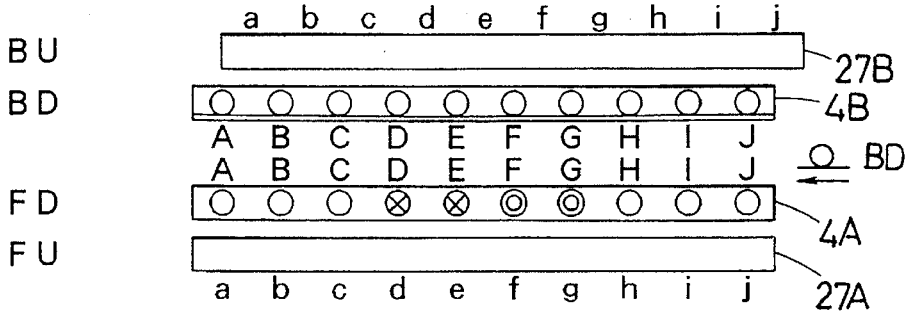

A tubular knit fabric is knitted by operating needles of both of a front and rear needle beds to knit circularly, as shown in FIG. 15A and 15B.

In a case that stitches are not crossed, swing lever 47 is erected to push down needle selecting butt 40 and keep it in an inoperable state. The needle selecting butt 40 can be restored to a waiting position by restoring cam 42.

Accordingly, when the carriage 2A (2B) passes the edge portion of the knitting goods, because the needle selecting means 30 of the transferring mechanism 5 exists outside of the transferring jack 29A (29B) to be selected and the needle selecting butt 40 is restored in a waiting position by restoring cam 42, the needle selected butts 40 of the transferring jacks 29A (29B) do not prevent the carriage 2A (2B) from moving even though the carriage 2A (2B) is moved in an adverse direction.

Figure 15C:
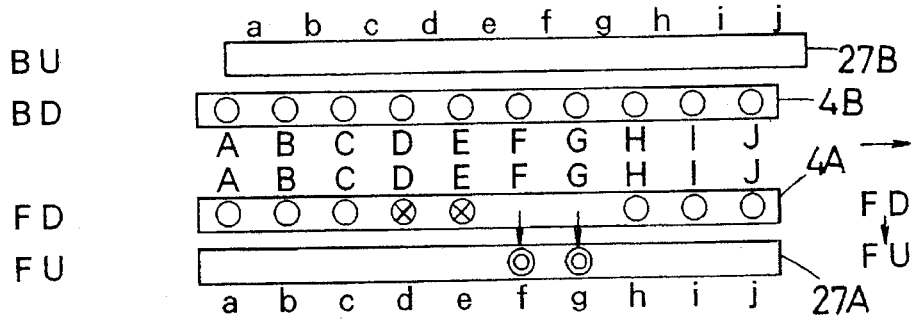
Figure 15D:
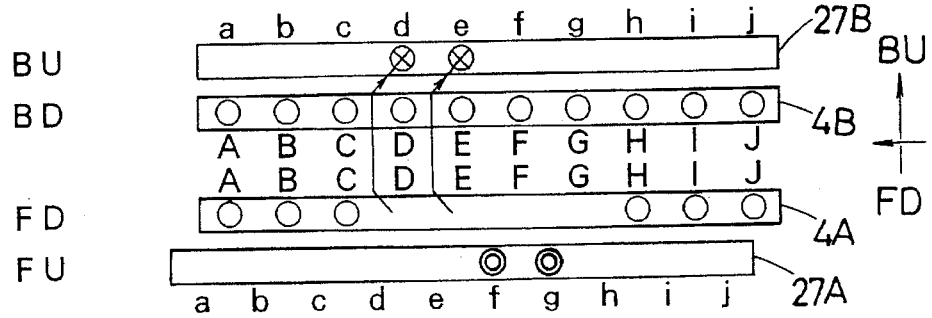

Stitches, engaged with knitting needles F and G of a front needle bed FD, are transferred to transferring jacks f and g of a front transferring jack bed FU, in FIG. 15C, and stitches, engaged with knitting needles D and E of a front needle bed FD, are transferred to transferring jack D and E of a rear transferring jack bed BU, in FIG. 15D.

In this embodiment, because the front and rear transferring jack beds are connected as shifted by a half (0.5) pitch and a pair of stitches to be crossed cannot be separately transferred to a front and a rear transferring jack beds at one time, stitches engaged with knitting needles D and B of a needle bed FD are transferred to transferring jack d and e, while stitches, transferred to transferring jack f and g, are passes through a bypass path as maintaining the stitches as they are.

Figure 16:
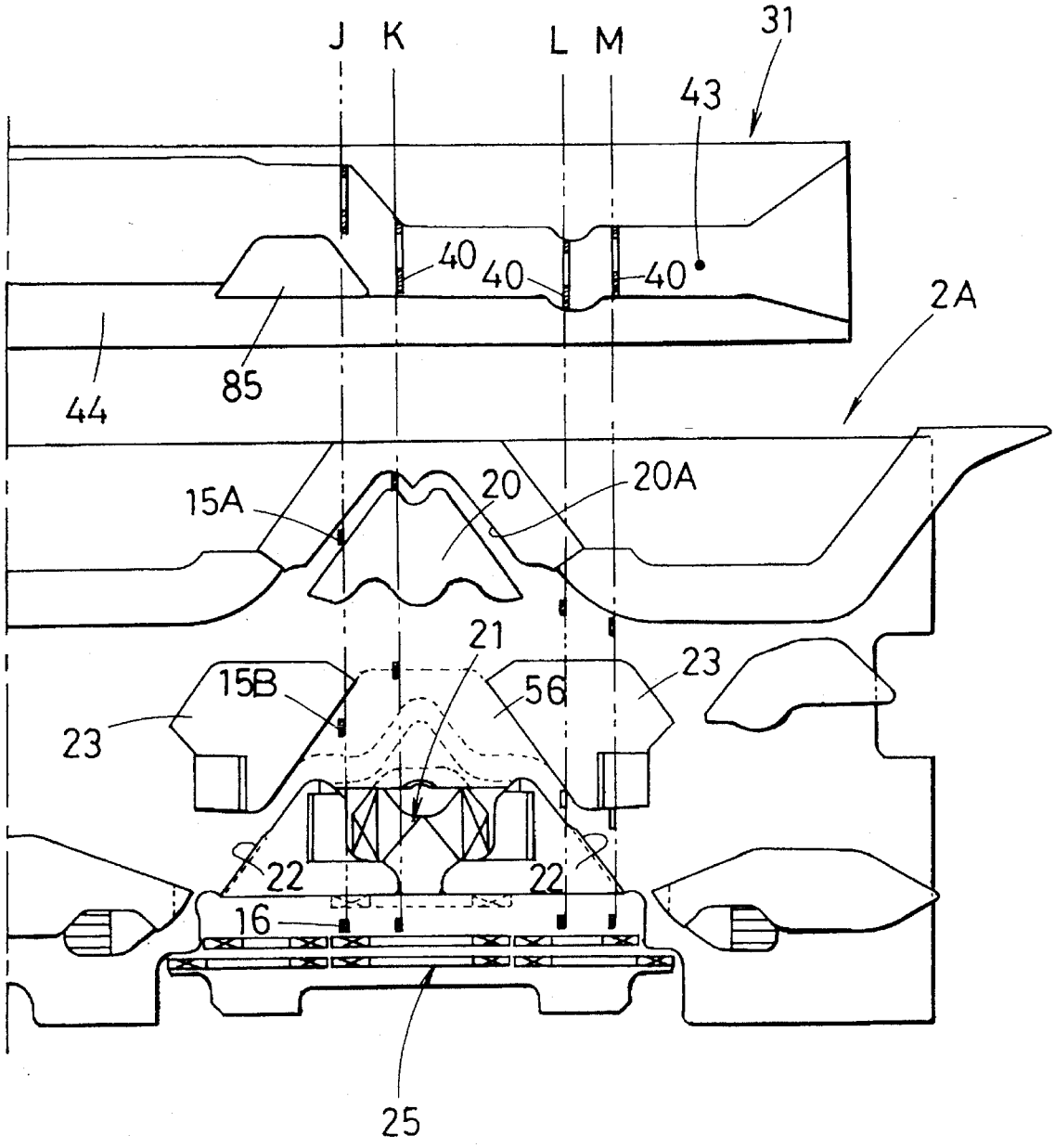
FIG. 16 is an elevational view illustrating the groups of the cams of the carriage and the relationship between positions of the cam groove of the transferring cam and the knitting needle.

Here, since a function transferring stitches engaged with knitting needles F and G of a front needle bed FD to transferring jacks f and g of a front transferring jack bed FU is about the same as a function transferring stitches engaged with knitting needles D and E of a front needle bed FD to transferring jacks d and e of a rear transferring jack bed BU, the function is explained in a more detail using an example of a function transferring stitches engaged with knitting needles D and E of a front needle bed FD to transferring jacks d and e of a rear transferring jack bed BU, in FIGS. 16 and 17.

FIG. 16 designate the group of cams of the carriage 2A for moving the knitting needles 3A on the front needle bed 4A, and the cam groove 43 on the cam plate 44 for operating the transferring jacks 29B in the rear transferring jack bed 27B. When the carriage 2A is moved on the needle bed 4A from right to left, the butts 15A and 15B of the jack 12 of the knitting needle 3 and the butt 16 of the selecting jack 13 of the knitting needle 3 pass in the group of cams of the carriage 2 from left to right as shown symbols J, K, L and M in FIG. 17A through FIG. 17D. For convenience, the case in which the stitch 52 engaged to the front knitting needle 3A is transferred to the adjoining front knitting needle 3A is explained.

Figure 17A:
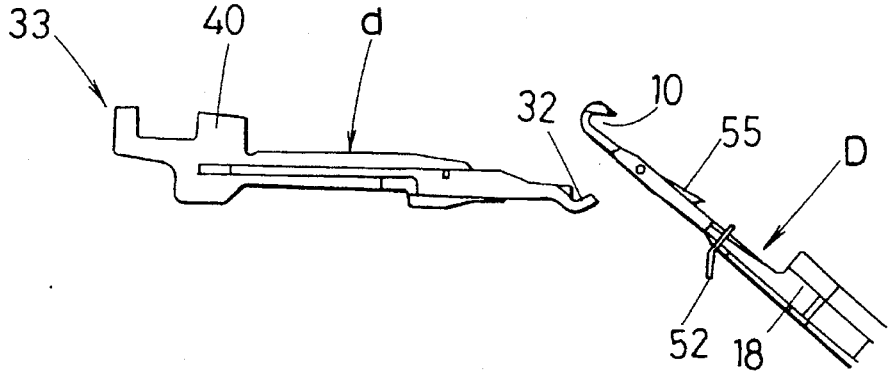
FIGS. 17A through 17D are side view of the relationship between positions of the knitting needle and the transferring jack in each position in FIG. 16.

When the front knitting needle D reaches the position J in FIG. 16, the butt 15A of the jack 12 is gradually pushed upwardly by the transferring raising cam 20 and thus the front knitting needle D is raised gradually. Therefore, as shown in FIG. 17A, the stitch 52 opens the latch 55 and the stitch 52 is also opened by a opening member 18.

Figure 17B:
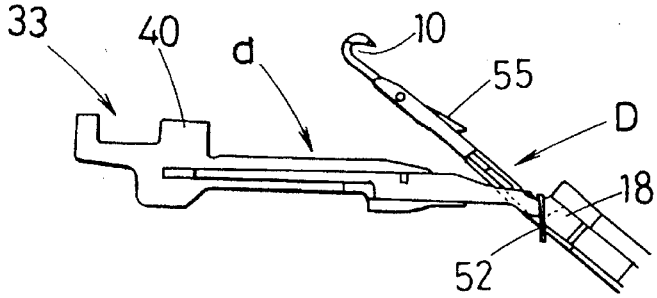

When the front knitting needle D reaches the position K, as shown in FIG. 17B, the front knitting needle D is projecting forward mostly and the needle selected butt 40 of the transferring jack d is pushed outwardly by the cam groove 43 of the cam plate 44 so to push the transferring jack 23B outwardly. The stitch engaging portion 32 is guided through the stitch 52 opened by the opening member 18 and then, the stitch engaging portion 32 receives the stitch 52.

Figure 17C:
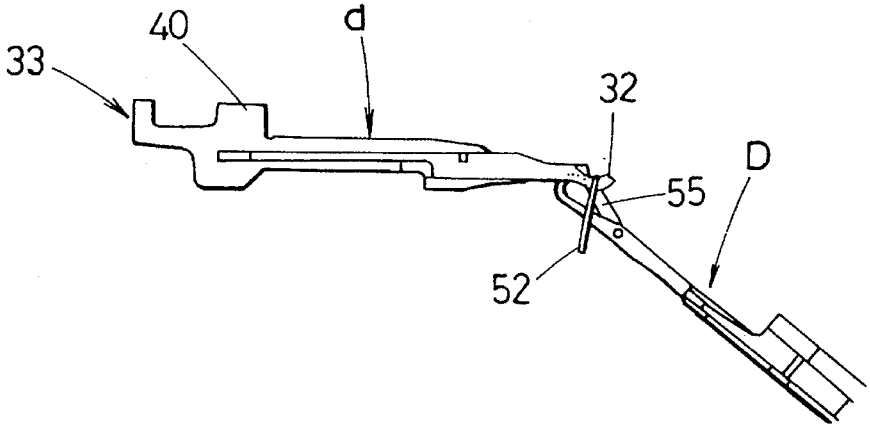

When the front knitting needle D reaches the position L, as shown in FIG. 17C, the front knitting needle D is retracted gradually because the butt 15A of the jack 12 is gradually pushed downwardly, and the needle selected butt 40 of the transferring jack d is pushed outwardly by the cam groove 43 of the cam plate 44 so that the stitch 52 does not interfere with the latch 55 when the front knitting needle D retracts.

Figure 17D:
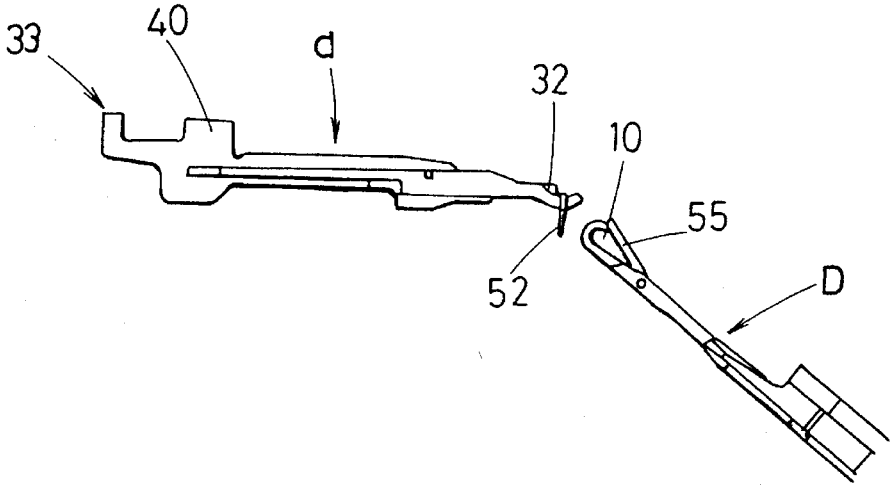

When the front knitting needle D reaches the position M, the butt 15B of the jack 12 passes the convex cam 23. As shown in FIG. 17D, the stitch 52 engaged with the front knitting needle D in FIG. 17A has been transferred from needle D to the stitch engaging portion 32 of the transferring jack d.

Figure 18A:
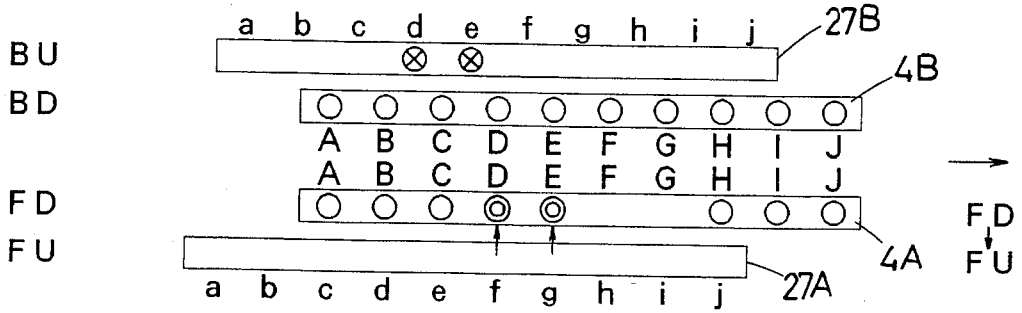
FIGS. 18A through 18B are explanatory drawings of knitting courses of a crossing pattern.
Figure 18B:
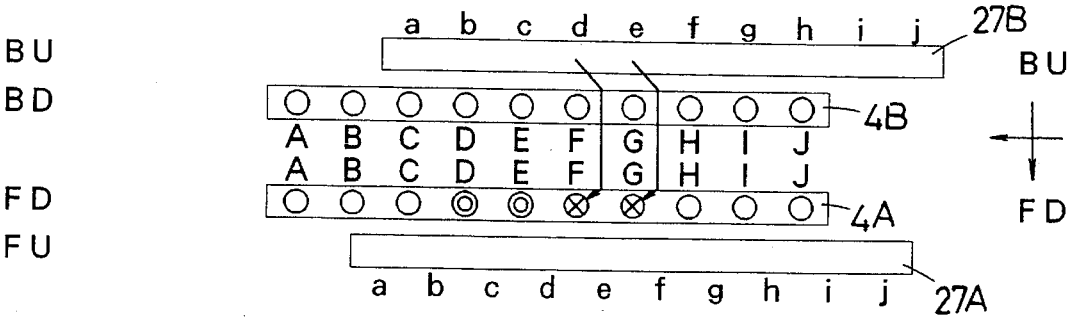

Thereafter, the front and rear transfer jack 27A(27B) are shifted leftward by two needle pitches while the stitches are maintained engaging with rear transferring jacks d and e, in FIG. 18A, and then stitches engaged with the front transferring jacks f and g to knitting needles D and E of the front needle bed 4A. At this time, a solenoid 87, disposed at cam plate 44, is operated to pull up a lift cam 85 of cam 43 in order to pass a carriage 2A while keeping the rear transferring jacks d and e engaged with stitches, as described in FIG. 17D.

Then, because a needle selecting butt 40 of transferring jack d and e pass through a straight bypass path (arrow of solid line) Y under the lower face of a lift cam 85, shown in FIG. 10, the transferring jacks d and e are not pulled down and the stitches can be maintained as held. Thereafter, the rear transferring jack bed BU is shifted rightward by four needle pitches in FIG. 18B to transfer the stitches engaged with transferring jacks d and e to knitting needles F and G of a front needle bed 4A, and then crossing pattern of 2×2 is formed on the front needle bed.

Figure 19:
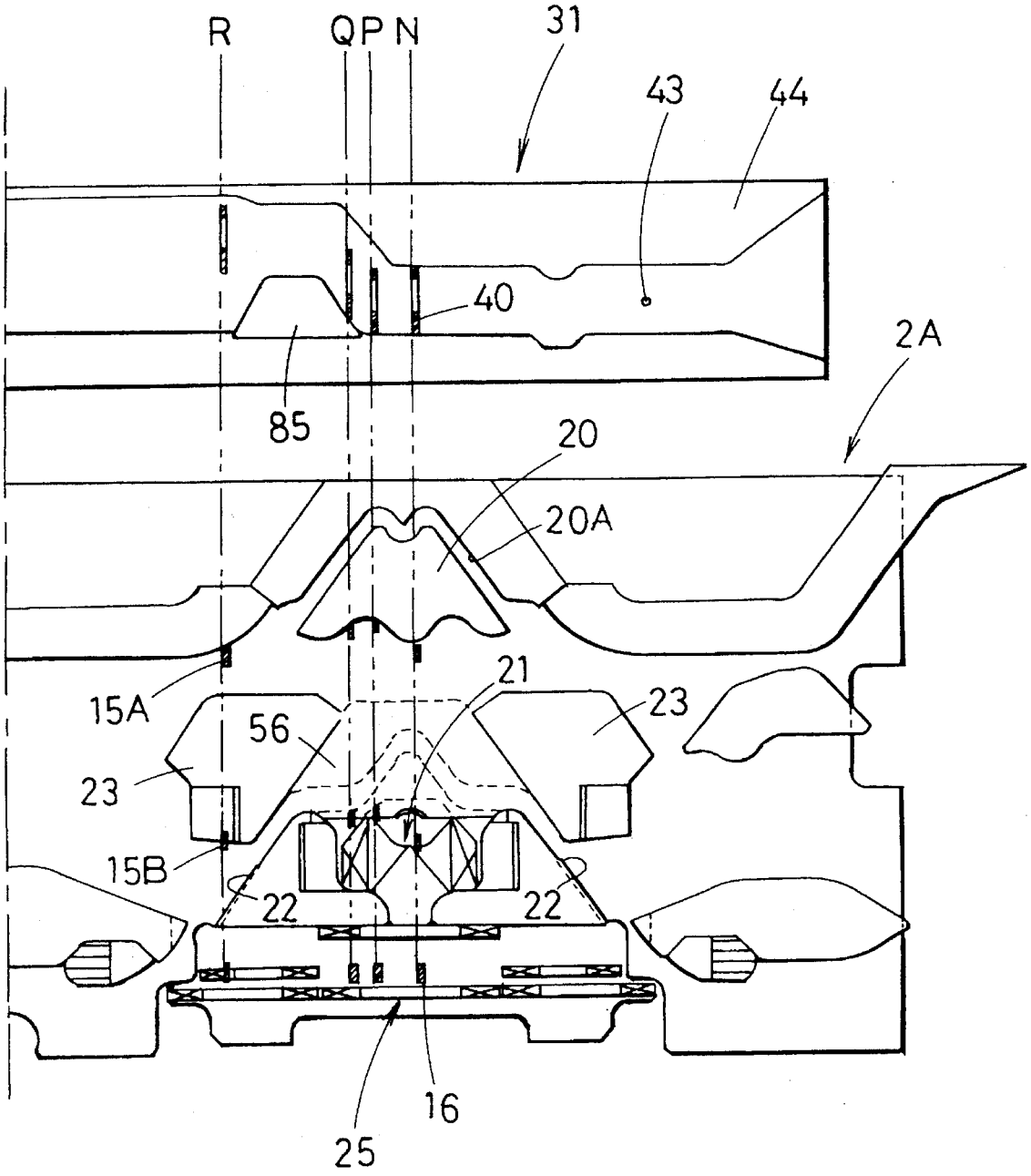
FIG. 19 is an elevational view illustrating the groups of the cams of the carriage and the relationship between positions of the cam groove of the transferring cam and the knitting needle.

The function is explained in a more detail using an example of a function transferring a stitch engaged with a transferring jack d to a front knitting needle F of the front needle bed 4A, referring to FIGS. 19 and 20.

FIG. 19 designate the group of cams of the carriage 2A for moving the knitting needle F on the front needle bed 4A, and the cam groove 43 on the cam plate 44 for operating the transferring jack d in the rear transferring bed 27B. When the carriage 2A is moved on the needle bed 4A from left to right, the butts 15A and 15B of the jack 12 of the knitting needle 3 and the butt 16 of the selecting jack 13 of the knitting 3 pass in the group of cams of the carriage 2A from right to left as shown symbols N, P, Q and R in FIG. 20A through FIG. 20D.

That is to say, when a front knitting needle for receiving a stitch 52 to be transferred, comes to a position P through N against a group of cams of a carriage 2A, a transfer receiving cam 21 moves to a butt 15B of the knitting needle F of the front needle bed 4A, a front needle F which the stitch is transferred to protrudes, and its hook 10 engages with the stitch and goes through a stitch engaging portion 32 of a rear transferring jack d kept as protruding, where the stitch 52 is engaged with the hook 10.

Figure 20A:
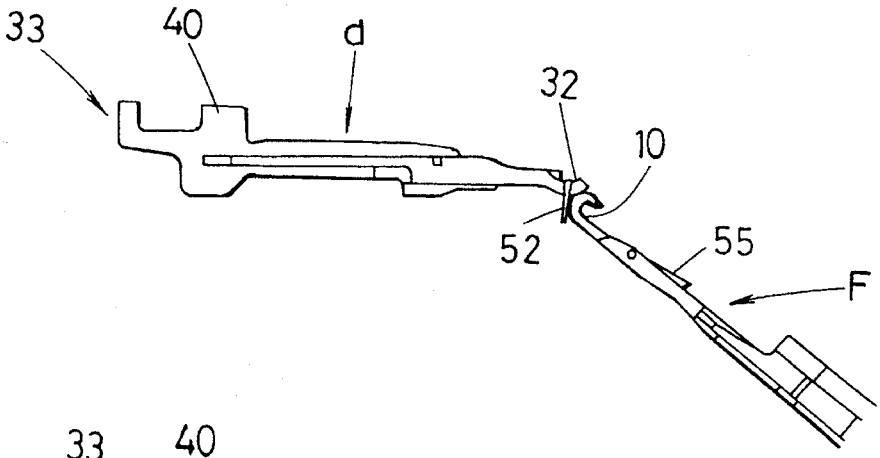
FIGS. 20A through 20D are side view of the relationship between positions of the knitting needle and the transferring jack in each position in FIG. 19.
Figure 20B:
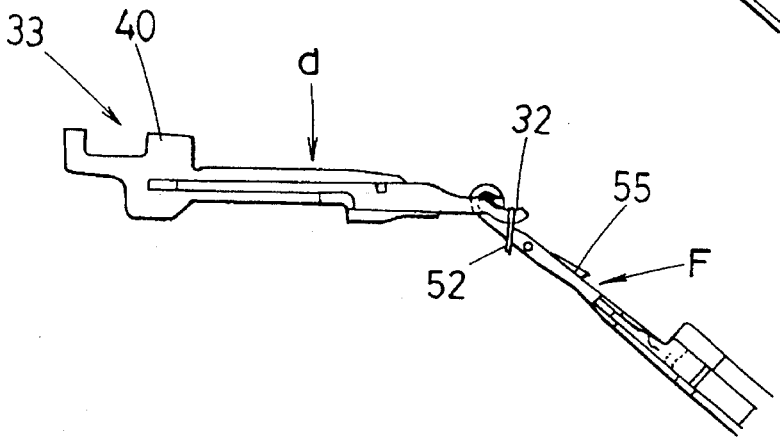
Figure 20C:
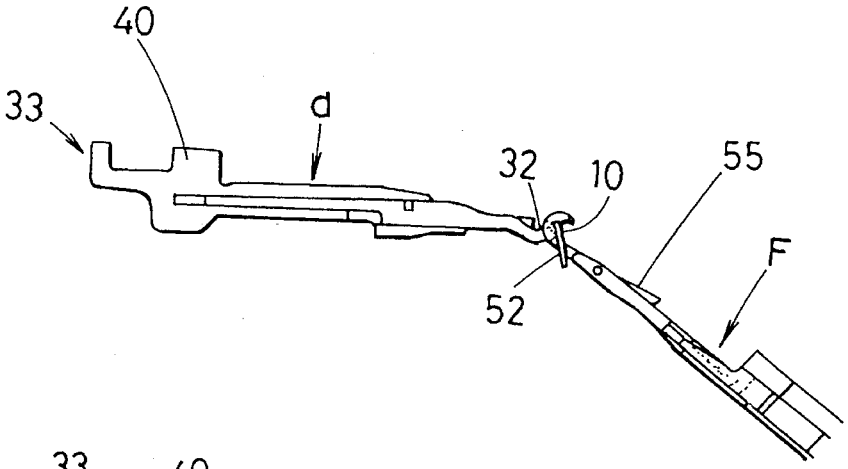

When the front knitting needle F reaches a position Q, against a group of cams of a carriage 2A, the front knitting needle F is gradually retracted by the transferring raising cam 20, and the transferring jack d begins to retract because the needle selected butt 40 of the transferring jack d is operated by the cam groove 43 of the cam plate 44. Therefore, as shown in FIG. 20C, the stitch 52 engaged with the stitch engaging portion 32 of the rear transferring jack d is transferred to the hook 10 of the front knitting needle F.

Figure 20D:
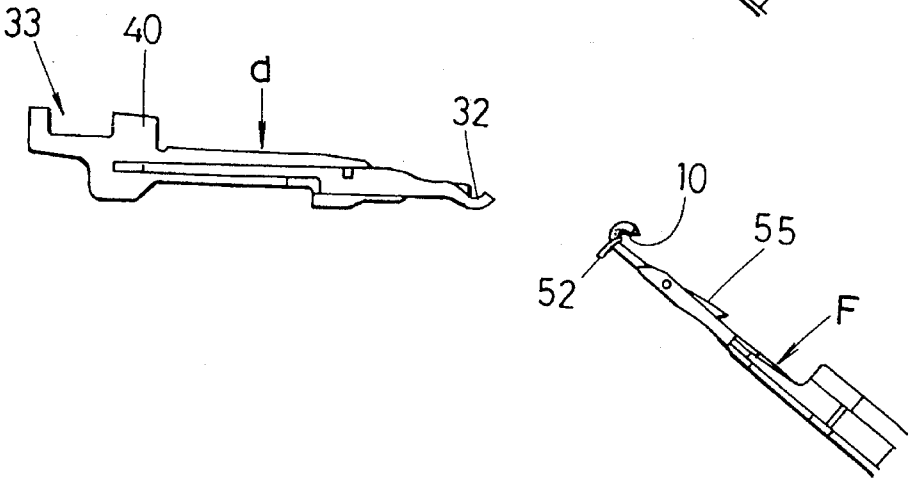

Subsequently, when the front knitting needle reaches the position R, against a group of cams of the carriage 2A, the transferring jack d is retracted further because the needle selected butt 40 of the transferring jack d is pushed inwardly by the cam groove 43 of the cam plate 44, the front knitting needle F which the stitch 52 is transferred is also retracted. As a result, the transfer of the stitch is completed, as shown in FIG. 20D.

In the above embodiment, a crossing pattern of 2×2 formed on a tubular knit fabric. However, the present invention is not restricted to a tubular knit fabric but may be practiced on a rib knit fabric, at a crossing pattern of 1×1, 3×3 or more, or also where numbers of crossing stitches different such as 2×3, as well.

What is claimed is:

1. A knitting apparatus for knitting a crossing pattern texture on a flat knitting machine, comprising:

a pair of front and rear needle beds, each of said front and rear needle beds having as plurality of needle grooves parallel and equally spaced along a length of said needle beds, each of said needle grooves having a needle therein;

needle cams for selectively advancing and retracting said needles in said needle grooves transverse of said needle beds for forming knit stitches on said needles in yarn fed to said needles as said needles are advanced and retracted;

a transferring jack bed supported by a support part above each of said needle beds;

transfer jacks each movable transverse of said jack beds in jack grooves parallel along a length of said jack beds;

a transferring cam for moving each of said transfer jacks in said jack groove forward and backward in said jack grooves by acting on jack butts on each of said transfer jacks, said transferring cam having a cam groove, a lift cam protruding into said cam groove for retracting said transferring jacks in said jack grooves, and means for moving said lift cams into and out of said cam groove of said transferring cam, wherein each of said transferring jacks is retracted in said jack groove or remains forward depending on said lift cam position being in or out of said cam groove of said transfer cam.

2. A knitting apparatus for knitting a crossing pattern texture on a flat knitting machine as recited in claim 1, wherein at least opposing pairs of transferring jacks opposing each other from above said needle beds are disposed at off-set positions in a longitudinal direction of said transferring jack beds wherein said jacks do not interfere with each other at opposing distal ends thereof when said opposing pairs of transfer jacks are extended, said front and rear transferring jack beds are connected to each other at least at one of the corresponding ends thereof, and said connected front and rear transferring jack beds can be moved in a longitudinal direction of said connected transferring jack beds.

3. A knitting apparatus for knitting a crossing pattern texture in a flat knitting machine as recited in claim 1, wherein said transferring jack beds supported above each of said needle beds face each other and are relatively moved with a driver mounted on at least one of said transferring jack beds.

* * * * *